US006350363B1

(12) United States Patent
Bradley

(10) Patent No.: US 6,350,363 B1
(45) Date of Patent: Feb. 26, 2002

(54) ELECTRIC FIELD DIRECTED CONSTRUCTION OF DIODES USING FREE-STANDING THREE-DIMENSIONAL COMPONENTS

(75) Inventor: Jean-Claude Bradley, Philadelphia, PA (US)

(73) Assignee: Drexel University, Philadelphia, PA (US)

( * ) Notice: Subject to any disclaimer, the term of this patent is extended or adjusted under 35 U.S.C. 154(b) by 0 days.

(21) Appl. No.: 09/576,521

(22) Filed: May 23, 2000

Related U.S. Application Data

(63) Continuation-in-part of application No. 09/061,818, filed on Apr. 16, 1998, now Pat. No. 6,120,669.

(60) Provisional application No. 60/101,363, filed on Sep. 22, 1998, provisional application No. 60/043,265, filed on Apr. 16, 1997, provisional application No. 60/048,475, filed on Jun. 3, 1997, provisional application No. 60/066,905, filed on Nov. 14, 1997, and provisional application No. 60/079,722, filed on Mar. 27, 1998.

(51) Int. Cl.[7] ..... C25D 7/12

(52) U.S. Cl. ..... 205/103; 205/114; 205/123; 205/136; 205/147; 205/157; 438/686; 438/687

(58) Field of Search ..... 205/103, 114, 205/118, 122, 123, 125, 136, 147, 157; 438/686, 687

(56) References Cited

U.S. PATENT DOCUMENTS

| | | | |
|---|---|---|---|
| 3,483,095 | A | 12/1969 | Bean |
| 3,485,725 | A | 12/1969 | Koretzky |
| 4,437,943 | A | 3/1984 | Beck et al. |
| 4,440,800 | A | 4/1984 | Morton et al. |
| 4,517,253 | A | 5/1985 | Rose et al. |

(List continued on next page.)

OTHER PUBLICATIONS

C. Gurtner et al., "Selective Construction of Electrical Connections Using an Organic Charge–Transfer Salt," *Adv. Mater.*, 8(11):897–899 (1996); month of publication not available.

C.L. Curtis et al., "Fabrication of Conducting Polymer Interconnects," *Science*, 262:2014–2016 (1993); month of publication not available.

H.S. White et al., "Chemical Derivatization of an Array of Three Gold Microelectrodes with Polypyrrole: Fabrication of a Molecule–Based Transistor," *J. Am. Chem. Soc.*, 106:5375–5377 (1984); month of publication not available.

G.P. Kittlesen et al., "A Microelectrochemical Diode with Submicron Contact Spacing Based on the Connection of Two Microelectrodes Using Dissimilar Redox Polymers," *Am. Chem Soc.*, 107(25):7373–7380 (1985); month of publication not available.

(List continued on next page.)

*Primary Examiner*—Kathryn Gorgos
*Assistant Examiner*—William T. Leader
(74) *Attorney, Agent, or Firm*—Akin, Gump, Strauss, Hauer & Feld, L.L.P.

(57) ABSTRACT

A process of making an electric current rectifying device using spatially coupled bipolar electrochemical deposition includes (a) placing at least two electrically conductive substrates, which may be a source of electrically conductive material, or a separate source of electrically conductive material, together with at least one semiconductor into an environment capable of conducting electricity and containing electrodes; (b) aligning the substrates and the semiconductor with respect to the electrodes such that the electrodes are not in contact with the substrates or the semiconductor and such that the material will form a conductive structure between and in contact with the substrates and the semiconductor when an electric field is applied between the electrodes; (c) to form a first electrically conductive structure between and in contact with a first of the substrates and the semiconductor; (d) reversing the polarity of the voltage to form a second electrically conductive structure.

20 Claims, 4 Drawing Sheets

U.S. PATENT DOCUMENTS

| | | | | |
|---|---|---|---|---|
| 4,589,959 | A | | 5/1986 | Nakamatsu et al. |
| 4,648,945 | A | | 3/1987 | Isenberg |
| 4,657,833 | A | | 4/1987 | Hadley, Jr. et al. |
| 4,681,665 | A | | 7/1987 | Guillermet et al. |
| 4,830,903 | A | | 5/1989 | Levy |
| 4,919,971 | A | | 4/1990 | Chen |
| 4,994,154 | A | | 2/1991 | Chen et al. |
| 5,141,602 | A | | 8/1992 | Chen et al. |
| 5,290,423 | A | | 3/1994 | Helber, Jr. et al. |
| 5,315,162 | A | | 5/1994 | McHardy et al. |
| 5,567,328 | A | | 10/1996 | Engle et al. |
| 5,603,819 | A | | 2/1997 | Harris et al. |
| 5,641,391 | A | | 6/1997 | Hunter et al. |
| 5,660,706 | A | | 8/1997 | Zhao et al. |
| 5,667,667 | A | | 9/1997 | Southern |
| 5,681,141 | A | | 10/1997 | Svendsen et al. |
| 5,686,207 | A | | 11/1997 | Suda et al. |
| 6,120,669 | A | * | 9/2000 | Bradley ..... 205/114 |

OTHER PUBLICATIONS

H.J. Keh, et al., "Interactions among Bipolar Spheres in an Electrolytic Cell," *J. Electrochem. Soc.*, 141(11):3103–3114;(Nov. 1994).

V. Fleury et al., "Runaway growth in two–dimensional electrodeposition," *Europhysics Letters*, 36(4):253–258 (1996); month of publication not available.

M.Z. Bazant, "Regulation of ramified electrochemical growth by a diffusive wave," *Phys. Rev. E.*, 52(2):1903–1914 (1995); month of publication not available.

R.H. Cork et al., "Local concentration measurement in electrochemical deposition using a schlieren method," *Phys. Rev. A*, 44(10):6940–6943 (1991); month of publication not available.

J.N. Chazalviel, "Electrochemical aspects of the generation of ramified metallic electrodeposits," *Phys. Rev. A*, 42(12) 7355–7367 (1990); month of publication not available.

V. Fleury et al., "Mechanism of a morphology transition in ramified electrochemical growth," *Nature*, 367:435–438 (1994); month of publication not available.

J–C Bradley et al., "Creating electrical contacts between metal particles using directed electrochemical growth," *Nature*, 389:268–271 (Sep. 18, 1997).

R.J. Von Gutfeld et al., "Cooper exchange plating on palladium and its relation to circuit repair," *Appl. Phys. Lett.*, 59(26):3490–3492 (Dec. 23, 1991).

G.B. Fefferman et al., "Testing Long–Term Corrosion of PC Materials," *Circuits Manufacturing*, 10–14 (1978–1979); month of publication not available.

J.N. Lahti et al., "The Characteristic Wearout Process in Epoxy–Glass Printed Circuits for High Density Electronic Packaging," *Proceedings of the 17th Annual Reliability Physics Symposium*, pp. 39–43 (1979); month of publication not available.

J.P. Mitchell et al., "Conductive Anodic Filament Growth in Printed Circuit Materials" *Proceedings of the Printed Circuit World Convention*, II, pp. 80–93 (1981); month of publication not available.

J.A. Augis et al., "A Humidity Threshold for Conductive Anodic Filaments in Epoxy Glass Printed Wiring Boards," *3rd International SAMPLE Electronic Conference*, pp. 1023–1031 & Abstract (Jun. 20–22, 1989).

S. Li, "Electrochemical Proceeding of Conducting Polymer Fibers," *Science*, 259:957–960 (Feb. 12, 1993).

M.J. Sailor et al., "Conducting Polymer Connections for Molecular Devices," *Adv. Mater.*, 6(9):88–692 (1994); month of publication not available.

M. Fujii et al., "Neuron–type Polypyrrole Device Prepared by Electrochemical Polymerization Method and Its Properties," Synthetic Metals, 71:2223–2224 (1995); month of publication not available.

C. Gurtner et al., "Selective Construction of Electrical Connections Using an Organic Charge–Transfer Salts," *Adv. Mater.*, 8(11):897–899 (1996); month of publication not available.

S. Cattarin et al., "Characterization and Processing of Bipolar Semiconductor Electrodes in a Dual Electrolyte Cell," *J. Electrochem. Soc.*, 142(11):3786–3792 (Nov. 1995).

S. Catterin et al., "Photoelectrochemistry at bipolar semiconductor electrodes," *J. Chim Phys.*, 93:650–661 (1996) month of publication not available.

R.J. Von Gutfeld et al., "Copper microcircuit repair of opens using thermally driven exchange plating," *Appl. Phys. Lett;*, 56(25):2584–2586 (Jun. 18, 1990).

M. Nishizawa et al., "Metal Nanotubule membranes with Electrochemically Switchable Ion–Transport Selectivity," *Science*, 268:700–702 (1995); month of publication not available.

C.R. Martin, "Nanomaterials: A Membrane–Based Synthetic Approach," *Science*, 266:1961–1966 (1994); month of publication not available.

C.A. Huber et al., "Nanowire Array Composites," *Science*, 263:800–802 (1994); month of publication not available.

W. Li et al., "Nanometer–scale electrochemical deposition of silver on graphite using a scanning tunneling microscope," *Appl. Phys. Lett.*, 60(10):1181–1183 (1992); month of publication not available.

L. Mirkova et al., "Anodic behaviour of copper during electrorefining using a rotating ring–disc electrode," *Journal of Applied Electrochemistry*, 24:420–425 (1994); month of publication not available.

* cited by examiner 18
12
14
10
16

18B
16B
Cu2+

20
Cu 2+

20

18E
16E
Cu2+
20

22
20
Cu2+

22
20

24

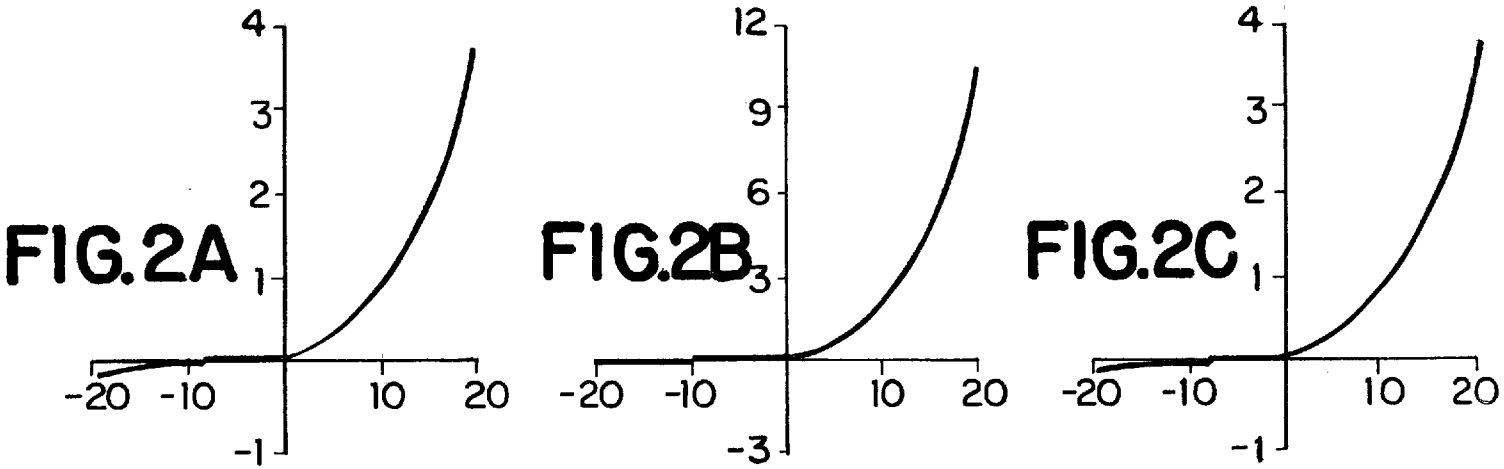
FIG.2A
FIG.2B
FIG.2C
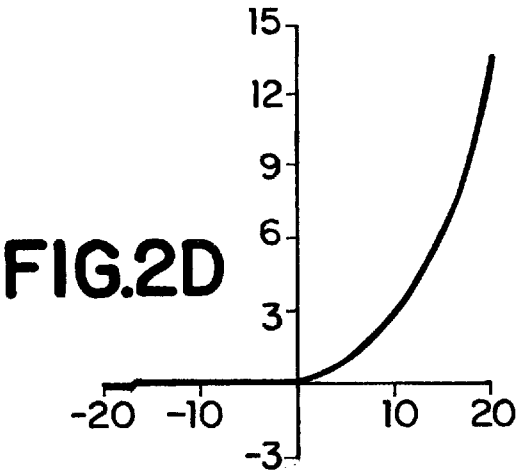
FIG.2D
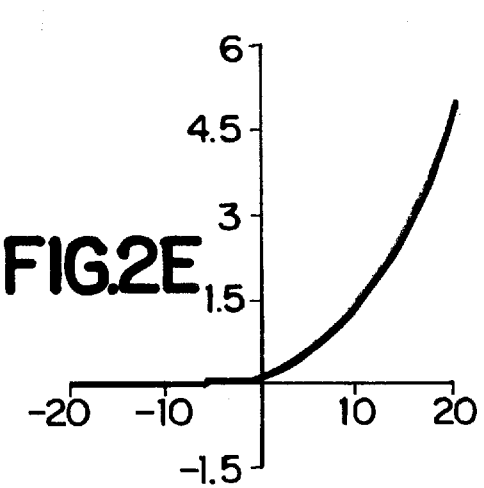
FIG.2E
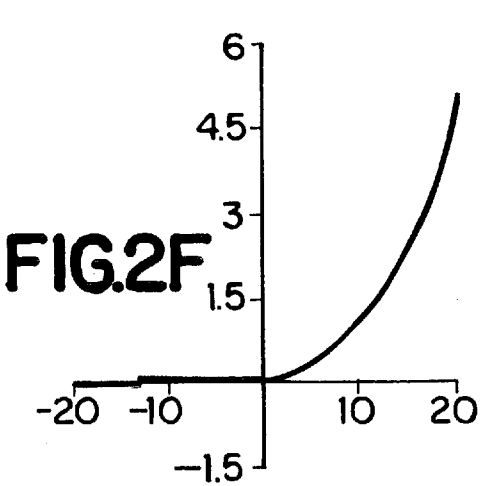
FIG.2F

ELECTRIC FIELD DIRECTED CONSTRUCTION OF DIODES USING FREE-STANDING THREE-DIMENSIONAL COMPONENTS

CROSS-REFERENCE TO RELATED APPLICATIONS

The application claims priority from U.S. Provisional Application No. 60/101,363, filed Sep. 22, 1998, and is a continuation-in-part of U.S. patent application Ser. No. 09/061,818, filed Apr. 16, 1998, now U.S. Pat. No. 6,120,669, the latter corresponding to International Patent Application No. PCT/US98/07699, filed Apr. 16, 1998 and published under International Publication No. WO/98/468 10, on Oct. 22, 1998. U.S. patent application Ser. No. 09/061,818 claims the benefit of U.S. Provisional Application No. 60/043,265, filed Apr. 16, 1997, U.S. Provisional Application No. 60/048,475, filed Jun. 3, 1997, U.S. Provisional Application No. 60/066,905, filed Nov. 14, 1997, and U.S. Provisional Application No. 60/079,722, filed Mar. 27, 1998. The disclosures of all of these related applications are hereby incorporated herein by reference.

BACKGROUND OF THE INVENTION

The metallization of semiconductors using an electrodeposition strategy is undergoing a tremendous renewal of interest, fueled by the recent success in utilizing copper interconnects in microchip fabrication. Copper is well suited as a replacement for the currently used aluminum principally due to its lower electrical resistivity and superior electromigration properties. Electrodeposition as a copper metallization strategy has been shown to offer significant advantages in terms of cost and ease of handling over other currently used metallization techniques such as evaporation, sputtering or chemical vapor deposition. A major advantage is that electrodeposition is a wet process and does not require vacuum conditions. Typically, a lithographic process is used to localize the copper deposit on the semiconductor surface, determined by the selective removal of a photoresist exposed to illumination through a patterned mask. Other approaches for metal patterning of surfaces have been explored involving scanning tunneling microscopy, imprint technologies or resistless patterning using photoelectrodeposition, ion-bombardment or localized thermal plating. However, in general, such approaches are only applicable to wiring on extremely flat and contiguous surfaces and usually require some type of contact or near contact with the semiconductor surface.

Copending U.S. patent application Ser. No. 09/061,818 described a novel technology which allows for the formation of electrical connections between isolated metal components. The method is based on the coupled electrodissolution and electrodeposition between two components in line with an electric field and is referred to as spatially coupled bipolar electrochemistry (sometimes hereinafter referred to as "SCBE"). A particular advantage of the method is that distances comparable in scale to the components involved can be spanned. This is in sharp contrast with conventional electrodeposition metallization strategies of semiconductors, which are limited either to the creation of thin films or the filling of templates.

The present invention is a novel extension of the technology of U.S. patent application Ser. No. 09/061,818 into making more devices not only in three dimensions using toposelective SCBE, but also into using the process for making electric current rectifying devices (diodes) by controlling the parameters of the SCBE process in a manner never thought of before. It was surprising that diodes would be formed using this process.

BRIEF SUMMARY OF THE INVENTION

One aspect of the present invention relates to a process of making an electric current rectifying device using spatially coupled bipolar electrochemical deposition comprising: (a) placing a source of electrically conductive material and at least two electrically conductive substrates and at least one semiconductor into an environment capable of conducting electricity and containing electrodes; (b) aligning the substrates and the semiconductor with respect to the electrodes such that the electrodes are not in contact with the substrates or the semiconductor and such that the material will form a conductive structure between and in contact with the substrates and the semiconductor when an electric field is applied between the electrodes; (c) applying a voltage to the electrodes to create a first electric field of a sufficient strength between the electrodes and for a time sufficient to form a first electrically conductive structure between and in contact with a first of the substrates and the semiconductor, the electrically conductive structure being substantially aligned with the first electric field; (d) reversing the polarity of the voltage applied to create a second electric field of a sufficient strength between the electrodes and for a time sufficient to form a second electrically conductive structure between and in contact with a second of the substrates and the semiconductor, the electrically conductive structure being substantially aligned with the second electric field; the semiconductor thus being transformed into the rectifying device.

Another aspect of the present invention relates to a process of making an electric current rectifying device using spatially coupled bipolar electrochemical deposition comprising: (a) placing at least two electrically conductive substrates comprising sources of electrically conductive material and at least one semiconductor into an environment capable of conducting electricity and containing electrodes; (b) aligning the substrates and the semiconductor with respect to the electrodes such that the electrodes are not in contact with the substrates or the semiconductor and such that the material will form a conductive structure between and in contact with the substrates and the semiconductor when an electric field is applied between the electrodes; (c) applying a voltage to the electrodes to create a first electric field of a sufficient strength between the electrodes and for a time sufficient to form a first electrically conductive structure between and in contact with a first of the substrates and the semiconductor, the electrically conductive structure being substantially aligned with the first electric field; (d) reversing the polarity of the voltage applied to create a second electric field of a sufficient strength between the electrodes and for a time sufficient to form a second electrically conductive structure between and in contact with a second of the substrates and the semiconductor, the electrically conductive structure being substantially aligned with the second electric field; the semiconductor thus being transformed into the rectifying device.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiment(s) which are presently preferred. It should be understood, however, that the invention is not limited to the precise arrangements and instrumentalities shown. In the drawings:

FIG. 1, comprising

FIG. 2, comprising FIGS. 2A–2L, are graphs depicting current (along the ordinate, in mA) vs. voltage (along the abscissa, in volts) characterizations of twelve samples of diodes prepared according to the present invention using the experimental design shown in FIG. 1, using a field intensity of 500 V/cm (electrode distance 2.0 cm) and a duration of 30 minutes for each wire growth.

FIG. 3 comprises images of micrographs 3A–3D showing various stages and details of the formation of a typical rectifying device made using the present invention.

DETAILED DESCRIPTION OF THE INVENTION

Figures 1A, 1B, 1C, 1D, 1E, 1F, 1G, 1H:
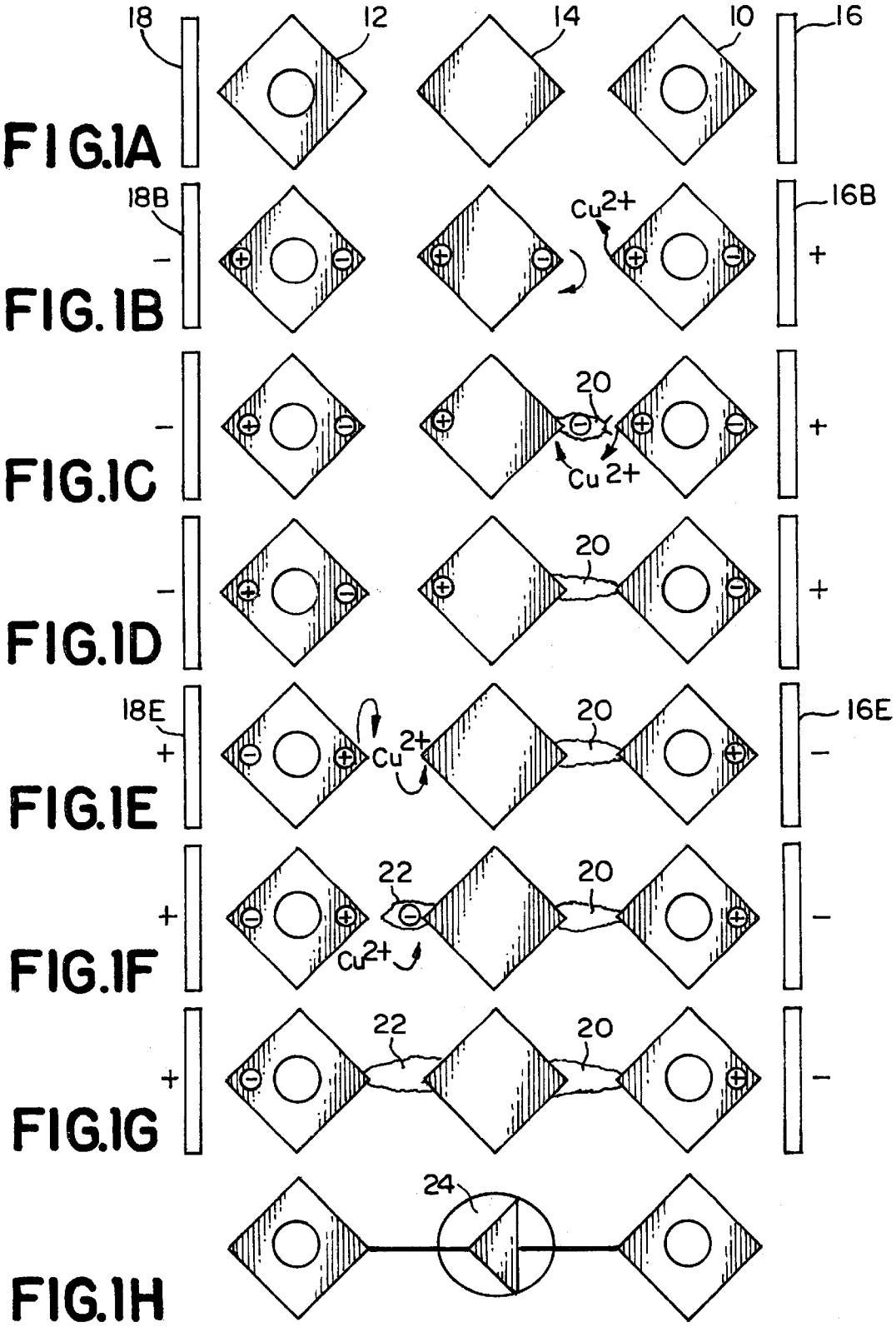
FIGS. 1A–1H, is a schematic representation of the formation of a rectifying device using (SCBE) according to the present invention. The distances are not drawn to scale.
Figure 2G:
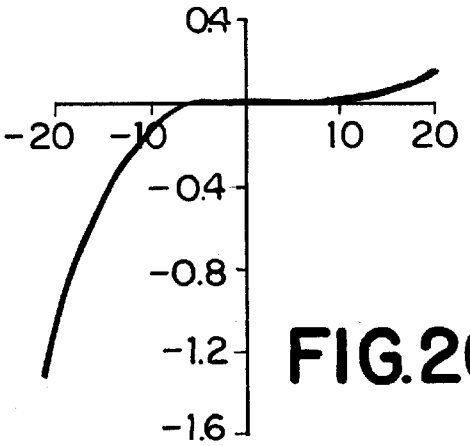
Figure 2H:
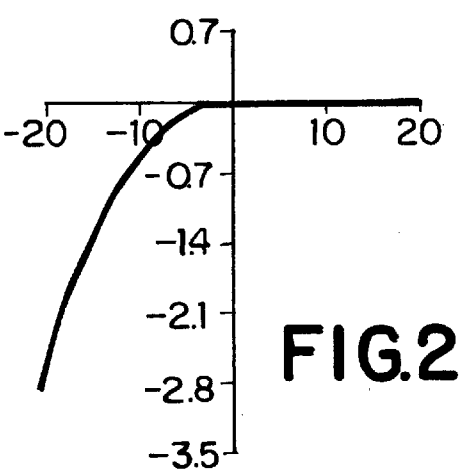
Figure 2I:
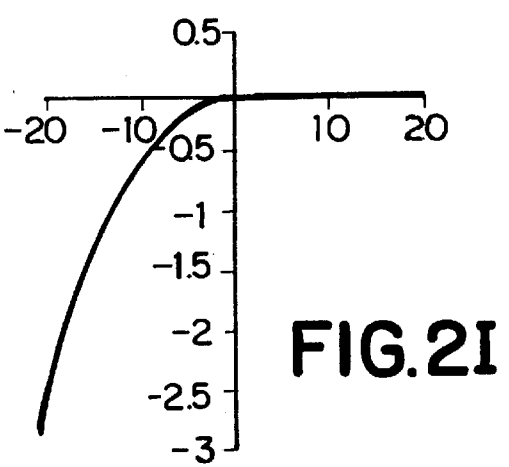
Figure 2J:
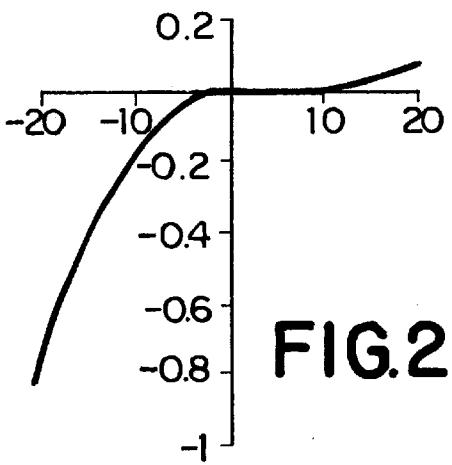
Figure 2K:
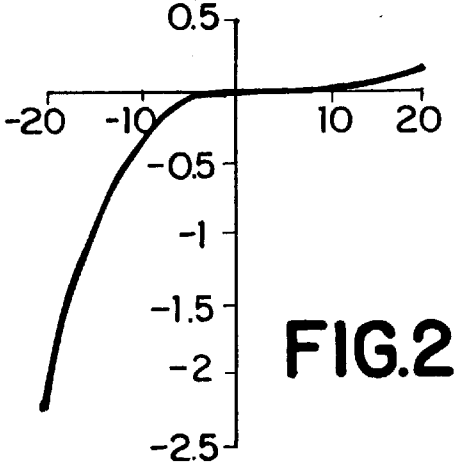
Figure 2L:
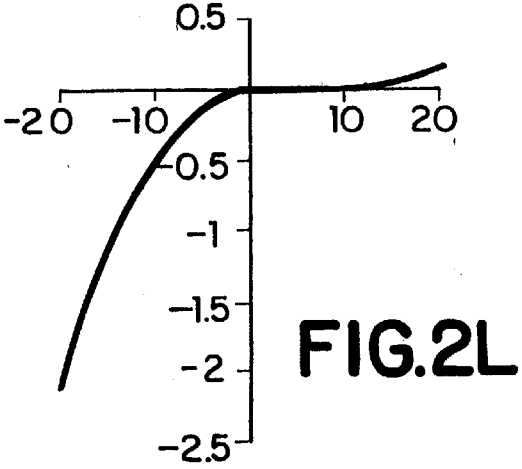

The present invention extends the formation of electrical contacts between components using electric fields from typically, but not necessarily only two components to typically, but not necessarily only three components, wherein at least one component, which is typically the central component, is a semiconductor, instead of a metal substrate, and wherein more than one field direction can be used, for example by growing two separate connections onto a central semiconductor component by using two different electric field vectors. In a preferred embodiment, contacts made between the semiconductor and the metallic substrates components are not equal, which permits the creation of diodes. Furthermore, the order in which the electric fields are applied controls the direction in which current will flow most easily in the resulting diode.

More particularly, in a preferred embodiment, the present invention uses spatially coupled bipolar electrochemistry (SCBE) to form electrical connections between isolated copper and homogeneously doped silicon structures. The technique is based on the spatially coupled electrodissolution from the copper component and subsequent electrodeposition onto the silicon chip caused by the application of an electric field in a highly resistive medium. When interconnects are formed between a central silicon chip and two copper structures positioned on opposite sides, an asymmetry ensues which results in the formation of a rectifying device, with the forward bias direction controlled by the order in which the connections are formed. The principal mechanism of rectification appears to be dominated by differences in contact areas caused by partial dissolution of copper at the metal-semiconductor interface of the first wire during the growth of the second wire. The ability to create and connect rectifying devices without using photolithography, templates or physical contact may lead to novel approaches to construct computational architectures, which are in principle not limited to planar surfaces.

The process of this invention is based on bipolar electrochemistry and many aspects are based on SCBE, which is best explained by example. When a pair of electrodissolvable substances, such as copper particles, rings or the like are exposed to an electric field, they become polarized, even if they are not contacted by the electrodes forming the anode and cathode. At sufficiently elevated electric fields, material resulting from electrodissolution of the electrodissolvable substance, such as copper, for example, from one particle aligned with the electrodes becomes spatially coupled via electrodeposition on the other particle aligned with the first particle and the electrodes, resulting in the formation of a conductor or wire between the particles. Even without direct contact between at least one electrode and the particle and preferably, without any contact between either of the electrodes and the particles, and further, without initial contact between the particles, spatial coupling occurs between the particles. Thus, it has been discovered that the electrochemical phenomena between the particles are governed solely by the electric fields generated between the electrodes. SCBE allows the growth of conductive structures on isolated components, where contact with either or both electrodes is not required, with the location of the growth of the conductive substance being controlled by the electric field direction, rather than by contact of the electrodes with either or both particles involved in the reaction.

The electrically conductive material to be connected to the substrates and the semiconductor(s) may be any material or substance that is capable of generating a conductive structure. A substance that is capable of generating a conductive structure is a metal ion that will electrodeposit in a conductive form such as a metal or metal oxide, a monomer which will electropolymerize into a conductive polymer, or an organic salt which electrocrystallizes into a conductive crystal. Any substance that is electrodissolvable in the electrically conductive environment may be used as the substance to be electrodeposited on the substrates and the semiconductor. The ions of any metal are preferred. Preferred metal ions are ions of Cu, Ag, Au, Pd, Pt, Co, Ni, Zn, In, Ga, Fe, Pb, Al, W, Ir, Cr, Cd, Re, Os, Mn and Sn. Ions of Cu and Ag are more preferred. The "source of electrically conductive material" may, and often preferably does include the material of the substrates themselves or the material of one substrate if the substrates are made of different materials. Alternatively, the "source of electrically conductive material" may be from a third material, such as that noted above.

Concerning electropolymerizable monomers, pyrrole and its derivatives, thiophene and its derivatives and aniline and its derivatives are preferred. Pyrrole is currently the most preferred electropolymerizable monomer. The preferred electrocrystallizable organic salt is a salt of tetrathiafulvene, although others would be known to those skilled in the art.

The substrates which may both receive the electroconductive material or substance and provide the electroconductive material or substance to the semiconductor (and thereby serve as a source) may be any electroconductive material. The substrate may be, for example, a metal or metal oxide, a conductive polymer or a conductive organic salt crystal. The more preferred substrate material is Cu and Ag, and where the electroconductive material is supplied from a source other than a substrate, other preferred substrates are Au or Pt.

The semiconductor may be an n-type or or a p-type, and may be made of a conductive form of carbon (such as graphite or forms of conductive diamond) and any other semiconductor material (such as doped silicon, InP, GaAs, CdS, CdSe, and the like). The preferred semiconductor material is silicon appropriately doped in a manner well known to those skilled in the semiconductor art.

The environment capable of conducting electricity is usually, but not exclusively, a liquid environment. Suitable environments include gases or even solids (e.g., ice or porous substances) so long as they have a dielectric constant lower than the conductive substrates and semiconductor(s) and can solvate the electrodepositable substance in a form in which it can electrodeposit onto the conductive substrates and semiconductor(s) upon application of an electric field.

Preferably the environment is a liquid or gel having the characteristics for the environment set forth above. The liquid or gel may contain additives such as an acid to remove oxides, a surfactant to prevent adhesion of gas bubbles, such as hydrogen gas that may be evolved, or other beneficial and optional additives.

When the electrodepositable substance is pyrrole, then a compound which induces or enhances conductivity of the polypyrrole should be present, such as sodium para-toluenesulfonate, on the order of about 0.1 mM to about 10 mM.

The choice of the environment depends on the type of metal or other electroconductive or electrodepositable material or substance, and the substrates and semiconductors used. One skilled in the art would be able to determine which environment is suitable for the situation based on electrochemical qualities involved in electrodissolution and electrodeposition. For example, in the case of copper and silver, the preferred environment is an aqueous solution containing up to 1 mM acid, preferably sulfuric acid such as at a concentration of about 0.01 mM, and up to 0.1 mM surfactant, preferably a nonionic surfactant, or an organic solution, preferably an acetonitrile/toluene mixture containing up to about 80 vol % toluene, and most preferably, 100% acetonitrile.

The electrodes may be any electrically conductive material connected to a voltage source, preferably a material that does not electrodissolve in the environment of the process. Gold, platinum and graphite are the preferred electrode materials. There may be instances where electrodissolvable electrodes are desired, however, where it is desired to deposit electrode material on the substrates and semiconductor(s), for example.

The present invention uses SCBE methodology to create rectifying devices, preferably using homogeneously doped semiconductive material, such as silicon and conductive substrates such as copper rings separated by several hundred micrometers. The process of the invention is shown schematically, initially with respect to FIG. 1, comprising FIGS. 1A through 1H., which shows that two electrical connections are grown using SCBE onto the opposite comers of a square silicon chip.

With reference to FIG. 1, and more particularly FIG. 1A, there is shown two substrate particles exemplified by a first square copper ring 10 and a second square copper ring 12, each having a square outer periphery and a circular cental hole. It is not necessary that the substrates be in the form of rings. A semiconductor, exemplified by a silicon chip 14, is positioned between the copper rings. These components may be positioned and supported on a printed circuit board of any typical insulator construction. The system is bathed in a suitable medium, such as acetonitrile with no supporting electrolyte, and two electrodes, generally identified by the numerals 16 and 18, such as platinum electrodes, are positioned at the opposite ends of the line of components, without making physical contact with any of the substrates 10 or 12 or the semiconductor 14.

The alignment of the electric field is achieved by appropriately aligning the substrates and semiconductor(s) with respect to the electrodes (or conversely, aligning the electrodes with respect to the substrates and the semiconductor (s)) and to the source of the substance or material to be electrodeposited (which as explained above, may be one or more of the substrates). In bipolar electrochemistry, the substance to be deposited is placed in alignment with the electric field vector between the cathode or negative electrode and the anode or positive electrode such that the electrodeposition takes place in a direction from the cathode to the anode. Thus, very site-selective electrodeposition can be achieved without contacting the substrate in any way with the electrodes or without contacting the substrates or semiconductors in advance with the substance to be deposited.

FIG. 1B depicts the situation when a voltage is applied across the platinum electrodes, where electrode 16B acts as an anode and electrode 16E acts as a cathode. This potential difference generates an electric field, which polarizes each component as shown. Copper electrodissolves from the anodically polarized region of the first copper ring 10 and the cuprous ions migrate to the cathodically polarized region of the silicon chip 14, where copper begins to electroplate in the form of a wire 20. The wire-like deposit continues to grow until it reaches the first copper ring 10, as depicted in FIGS. 1C and D.

The voltage difference must be sufficient to create a field intensity sufficient to accomplish SCBE. Field intensity is dependent upon the smallest cross-sectional dimension of the substrates and semiconductor(s) aligned with the electric field. Substrates or semiconductors with smaller cross-sectional dimensions require a greater field intensity. One skilled in the electrochemistry art having read this disclosure could determine without undue experimentation the appropriate electric field and related process parameters to be used in various circumstances. For example and without limitation, where the substrates and semiconductor(s) have cross-sectional dimensions of about 2 mm, voltages that generate a field intensity of at least about 10 V/cm should be adequate to induce the electrochemical processes necessary for SCBE to be operative. A preferred field intensity for this size of the substrates and semiconductor(s) is about 500 V/cm.

As shown in FIG. 1E, the field polarity is reversed, such that the electrode 18E becomes the anode and the electrode 16E becomes the cathode. The voltage is maintained and the process described above is repeated to grow a wire-like deposit 22 between the silicon chip 14 and the second copper ring 12. After immersing the components in an electroless copper plating solution, a rectifying device is generated with the rectification properties shown schematically in FIG. 1H for n-Si. The direction of rectification would be opposite for p-Si or if the order of wire growth had been reversed.

The field should be applied for a time sufficient to allow for growth of the wires between the substrates and the semiconductor(s) using SCBE. The time is dependent both on the field intensity and the distance between the substrates and the semiconductor(s). Again by way of example and not limitation, when a field intensity of about 500 V/cm is applied to the system in which the substrates and semiconductor(s) have a cross-sectional dimension of about 2 mm and the space between each substrate and the semiconductor is about 0.5 mn, each of the wires grow in about 30 minutes.

The first connection is grown by applying an electric field in a direction favoring the electrodissolution of copper ions from the first copper ring 10 into the region facing the silicon chip 14. Since the comer of the chip exposed to this liberated copper ion cloud is cathodically polarized, a ramified wire-like electrodeposit 20 grows from that comer until it reaches the first ring 10. When the direction of the electric field is reversed, preferably after rinsing the components and applying fresh electrically conductive medium, such as the acetonitrile for example, the same process is repeated on the opposite side of the silicon chip and a second deposit forms between the silicon chip 14 and the second copper ring 12.

As described previously in copending U.S. patent application Ser. No. 09/061,818, subsequent immersion of the system into an electroless plating bath ensures a solid connection between the silicon and copper components. In this aspect, where the bipolar electrochemical environment is a liquid electrically conductive environment, the process further preferably comprises removing the components formed into a rectifier as described above, preferably drying the device and the circuit board on which the electrically conductive structure was formed to adhere the structure to the circuit board, and then electrolessly plating the same or a different electrically conductive material on the electrically conductive structure until a desired thickness of the electrically conductive structure is obtained.

The present invention will now be described in further detail with reference to the following specific, non-limiting Example.

Copper-silicon contacts are known to form blocking (Schottky) junctions for both n-type and p-type silicon. (Cros, A.; Muret, P. Materials Science Reports 8, 271 (1992)). Thus, an experiment was devised to measure the I-V (current-voltage) measurements as graphed in the graphs of FIG. 2 between two copper substrates 10 and 12 connected through the central silicon chip 14 and to determine the reverse characteristics of each contact.

Figure 3A:
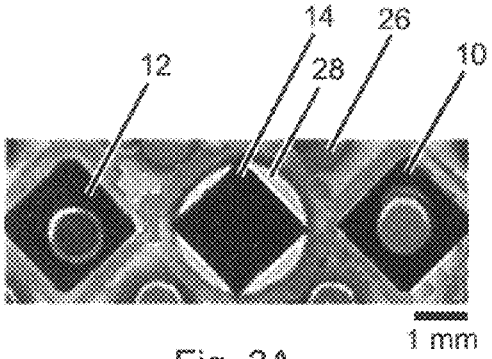
FIGS. 3A and 3B are top plan views with scale bars for indicating relative size and distance.
Figure 3B:
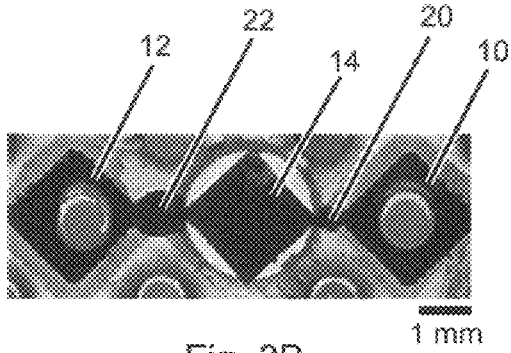

Twelve sample devices were constructed as explained above generally with respect to FIG. 1. An exemplary arrangement and an exemplary device are shown in FIG. 3. Silicon wafers were cut to form chips 14 of n-type Si with dimensions of 2.12 mm×2.12 mm then mounted as shown in FIG. 3A on a circuit board 26 and inserted into a hole 28 drilled into the circuit board. N-type Si was used for six samples and p-type Si was used for the other six samples. The n-type 100-cleaved silicon was P-doped with a resistivity of 1.3 Ωcm; the p-type 100-cleaved silicon was B-doped with a resistivity of 4.9 Ωcm. Square copper rings 10 and 12 of approximately the same dimensions as the silicon chips were formed and mounted on the circuit board 26 in the relationship and at the distances indicated in FIGS. 3A and 3B. All excess copper present on the board was removed by scratching with a sharp tool. The platinum electrodes are not shown.

The electrically conductive environment was acetonitrile distilled from CaH.

The wire growth was carried out under $N_2$ by applying and maintaining for 30 min. a voltage differential of 1000 volts, given that the distance between the two electrodes is 2.0 cm, to create a field intensity of 500V/cm, first with the anode adjacent to but not in contact with the first copper ring 10. The solution was replaced before the field direction was switched. The procedure just described was repeated using the same parameters mentioned, except that the anode was adjacent to but not in contact with the second copper ring 12.

Immediately after completing the application of the field in the reverse direction, the samples were washed with distilled water then dried and put into an electroless copper plating solution (Technic™ EC-70) for 3 hr. at room temperature, and finally washed and dried again.

The current-voltage curves shown in FIGS. 2A–2L were measured with a 4145 Semiconductor Parameter Analyzer. FIGS. 2A–2F are current-voltage curves obtained between the two copper rings for identical experiments using n-Si. For FIGS. 2G to 2L, p-Si was used. In FIGS. 2A through 2F, positive voltages refer to polarization of the first copper ring 10 where growth of the first wire, represented by wire 20, occurred. In FIGS. 2G through 2L, negative voltages refer to polarization of the second copper ring 12 where growth of the second wire, represented by wire 22, occurred.

Maximal rectification ratios in the range of 15–473 were found and are shown in the Table below, following the written description. The reverse bias of the Cu/n-Si interface corresponds to electron movement from the metal into the semiconductor, with the opposite being the case for the Cu/p-Si interface. Consequently, analysis of the I–V curves in FIG. 2 indicates that, for both n- and p-doped Si, either a lower barrier or a larger contact area is found for the second contact (wire). Although both contacts are prepared using identical field intensities and duration, the graphs of FIG. 2 reveals highly asymmetric I–V curves, reflecting large differences in the reverse characteristics of the two contacts.

Figure 3C:
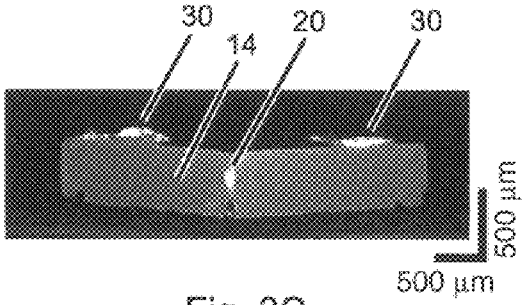
FIGS. 3C and 3D are edge views of the silicon chips as shown in FIGS. 3A and 3B taken at a 45° angle. The vertical and horizontal scale bars are asymmetrical because the view along the edges in FIGS. 3C and 3D is at the indicated angle.
Figure 3D:
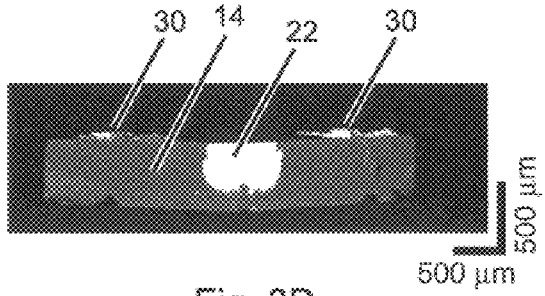

The optical micrograph of a typical experiment shown in FIGS. 3C and 3D confirm the graphical data. FIG. 3C is a scanning electron micrograph of the contact area where copper is deposited on the corner of first wire 20 grown on a typical silicon chip. FIG. 3D is the same as FIG. 3C, but shows the corner of the second wire growth 22. In FIGS. 3C and 3D, the bright areas in the center, designated by numerals 20 and 22, respectively, correspond to copper. The material 30 on the top left and right of the chips is an In-Ga alloy that was added for the independent measurements of each contact.

In general, Schottky barrier heights are best estimated using forward current-voltage (I–V) characteristics based on the thermionic-emission model. (Okumura, T.; Yamamoto, S.-I.; Simura, M. *Jpn. J. Appl. Phys.* 32, 2626 (1993)). Since only reverse bias information is obtained by contacting the two copper components, ohmic contacts were introduced by rubbing an In-Ga alloy at the other two corners to interrogate each copper contact separately. From the contact areas measured by SEM and the saturation current JS obtained from the I–V data, the Schottky barrier heights $\phi_B$ for the n-Si/Cu contacts were calculated and are reported in the Table. Values ranging from 0.61 eV to 0.75 eV are obtained, consistent with the range of values in the literature obtained using the same method of analysis for Cu/n-Si contacts measured from electroless deposition (0.62 eV reported in Lee, M. K.; Wang, H. D.; Wang, J. J. *Solid State Electronics*, 41, 695 (1997); 0.68 eV reported in Datta, A. K.; Ghosh, K.; Chowdhury, N. K. D.; Daw, A. N. *Solid State Electronics*, 23, 905 (1980)) or electrolytic deposition (0.69 eV reported in Ghosh, K.; Chowdhury, N. K. D. *Int. J. Electronics*. 54, 615 (1983); 0.58 eV reported in Singh, B. K.; Mitra, R. N.; Daw, A. N. *Indian J. Pure Appl. Phys.* 18, 368 (1980); 0.74 eV reported in Wurst, E. C.; Bomeman, E. H. *J. Appl. Phys.* 28, 235 (1957)).

The large ideality factor (n>1.5) and the soft reverse characteristics suggest that interfacial oxide and/or non-uniform contacts contribute significantly to the I–V characteristics observed in the graphs of FIG. 2. Irregular contacts such as those present in porous silicon/copper interfaces as reported by Wang, G.-S.; Peng, L.; Ma, Y.-R.; Fang, R. C. *Chin. Phys. Lett.* 14, 124 (1997), or by pinholes in oxide layers as reported by Kabushemeye, E.; van Meirhaeghe, R. L.; Laflere, W. H.; Cardon, F. *Semicond. Sci. Technol.* 4, 543 (1989), are known to produce large ideality factors. Anodic oxidation, which is expected to occur in this system, is also known to create thick oxide layers which generate very large ideality factors (Okumura, T.; Yamamoto, S.-I.; Simura, M. *Jpn. J. Appl. Phys.* 32,2626 (1993)).

The scanning electron micrographs revealed large differences between the areas of the first and second contacts (see the Table and FIGS. 3C and 3D), well in accord with the hypothesis that contact area is largely responsible for the trends observed in FIG. 2. The origin of these differences was probed by measuring the apparent contact area on both sides of the chip, at each step of device construction. The most salient finding from these investigations is that the first contact is initially as large as the second, but becomes significantly reduced after the growth of the second wire (see the Table entries M–R). An explanation for this is that, during the growth of the second wire, the initially deposited copper electrodissolves at the silicon interface while that comer of the chip is anodically polarized. The electrodissolution appears to be limited to the Cu/Si interface leaving the path to the copper component intact. Subsequent electroless copper deposition treatment ensures proper contact between each copper ring and the silicon chip without significantly increasing the apparent contact area on both corners (compare the Table entries P–R and A–L). Such a mechanism supports the formation of contacts by SCBE at adjacent corners that would not show significant asymmetry in the resulting I–V curve, which is borne out by experiment (data not shown).

Although differences in contact area seem to account for the bulk of the behavior of the devices formed, other mechanisms may play a role. Indeed, under certain circumstances, such as the use of other metals and semiconductors, or at different scales and field intensities, such effects may become dominant. For example, it is possible that preferential migration of copper into the interfacial oxide at the second wire Cu/Si interface could contribute to the device asymmetry (Miyazaki, H.; Kojima, H.; Hinode, K. *J. Appl. Phys.* 81, 7746 (1997)). Another possible complication is electrochemical doping, which may involve penetration of copper ions into the semiconductor. Interstitial copper is known to be a donor in silicon and, although electromigration of copper within silicon has been used to create devices (Cahen, D.; Chemyak, L. *Adv. Mater.* 9, 861 (1997)), the effect is rather weak compared to the effect caused by the differences in contact areas. However, in other systems, such as HgCdTe, electrochemical copper doping can be significant enough to lead to type conversion (Talasek, R. T.; Ohlson, M. J.; Syllaios, A. J. *J. Electrochem. Soc.* 133, 230 (1986)). This suggests that for other metal-semiconductor systems, device creation by type conversion may become the dominant effect.

The experiments discussed herein support a proof-of-principle demonstration of the present invention of creating rectifying devices by electrically connecting isolated semiconductor and metal structures without lithography or physical contact, using SCBE. Although the direct metallization of silicon with copper may prove to be unsuitable for many applications due to known problems of device degradation, the introduction of suitable diffusion barriers such as Ta or $Si_3N_4$ (both as reported in Hu, C.-K; Harper, J. M. E *Mater. Chem. Phys.* 52, 5 (1998)), or TiN (as reported by Li, J.; Mayer, J. W.; Shacham-Diamand, Y.; Colgan, E. G. *Appl. Phys. Lett.* 60, 2983 (1992)), should overcome such difficulties. Such a barrier may also enhance device properties by preventing the formation of interfacial oxide during anodic polarization.

Furthermore, since the electrolytic step of the process appears to serve principally to lay down a seed layer at the surface of the semiconductor, other choices for the electroless plating bath could be used to create arbitrary metal-semiconductor contacts varying from ohmic to strongly rectifying. In addition, the mechanism believed to be operating in the present system supports the reasonable belief that this technique should be applicable to many other semiconductors of current interest including GaAs, InP and CdS.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

TABLE

Characterization of the rectifying devices

| | Sample No. | SEM Contact Area of Wire 1 ($\mu m^2$) | SEM Contact Area of Wire 2 ($\mu m^2$) | Max. Rectification ratio | $-\phi B$ (eV) Wire 1 | $-\phi B$ (eV) Wire 2 | Ideality Factor(n) Wire 1 | Ideality Factor(n) Wire 2 |
|---|---|---|---|---|---|---|---|---|
| After Electroless Plating | | | | | | | | |
| n type Si | A | 28 850 | 182 716 | 27 | 0.75 | 0.64 | 3.5 | 2.9 |
| | B | 14 610 | 224 989 | 47 | 0.64 | 0.63 | 3.9 | 3.8 |
| | C | 5 303 | 178 581 | 27 | 0.72 | 0.62 | 4.2 | 3.9 |
| | D | 6 629 | 307 555 | 168 | 0.69 | 0.69 | 1.9 | 2.6 |
| | E | 8 413 | 284 105 | 169 | 0.74 | 0.63 | 2.5 | 4.0 |
| | F | 365 | 183 082 | 184 | 0.66 | 0.61 | 2.6 | 3.8 |
| p type Si | G | 14 600 | 87 700 | 15 | | | | |
| | H | 43 100 | 349 000 | 473 | | | | |
| | I | 19 600 | 329 000 | 474 | | | | |
| | J | 44 900 | 280 000 | 108 | | | | |
| | K | 34 400 | 317 000 | 22 | | | | |
| | L | 42 800 | 199 000 | 322 | | | | |
| Before Plating | | | | | | | | |
| One wire Only | M | 382 000 | | | | | | |
| | N | 339 000 | | | | | | |
| | O | 198 000 | | | | | | |
| Both wires | P | 32 100 | 206 000 | | | | | |

TABLE-continued

Characterization of the rectifying devices

| | Sample No. | SEM Contact Area of Wire 1 ($\mu m^2$) | SEM Contact Area of Wire 2 ($\mu m^2$) | Max. Rectification ratio | $-\phi B$ (eV) Wire 1 | $-\phi B$ (eV) Wire 2 | Ideality Factor(n) Wire 1 | Ideality Factor(n) Wire 2 |
|---|---|---|---|---|---|---|---|---|
| Grown | Q | 8 800 | 126 000 | | | | | |
| | R | 46 800 | 175 000 | | | | | |

What is claimed is:

1. A process of making an electric current rectifying device using spatially coupled bipolar electrochemical deposition comprising:

(a) placing a source of electrically conductive material and at least two electrically conductive substrates and at least one semiconductor into an environment capable of conducting electricity and containing electrodes;

(b) aligning the substrates and the semiconductor with respect to the electrodes such that the electrodes are not in contact with the substrates or the semiconductor and such that the material will form a conductive structure between and in contact with the substrates and the semiconductor when an electric field is applied between the electrodes;

(c) applying a voltage to the electrodes to create a first electric field of a sufficient strength between the electrodes and for a time sufficient to form a first electrically conductive structure between and in contact with a first of the substrates and the semiconductor, the electrically conductive structure being substantially aligned with the first electric field;

(d) reversing the polarity of the voltage applied to create a second electric field of a sufficient strength between the electrodes and for a time sufficient to form a second electrically conductive structure between and in contact with a second of the substrates and the semiconductor, the electrically conductive structure being substantially aligned with the second electric field, the semiconductor thus being transformed into the rectifying device.

2. A process of making an electric current rectifying device using spatially coupled bipolar electrochemical deposition comprising:

(a) placing at least two electrically conductive substrates comprising sources of electrically conductive material and at least one semiconductor into an environment capable of conducting electricity and containing electrodes;

(b) aligning the substrates and the semiconductor with respect to the electrodes such that the electrodes are not in contact with the substrates or the semiconductor and such that the material will form a conductive structure between and in contact with the substrates and the semiconductor when an electric field is applied between the electrodes;

(c) applying a voltage to the electrodes to create a first electric field of a sufficient strength between the electrodes and for a time sufficient to form a first electrically conductive structure between and in contact with a first of the substrates and the semiconductor, the electrically conductive structure being substantially aligned with the first electric field;

(d) reversing the polarity of the voltage applied to create a second electric field of a sufficient strength between the electrodes and for a time sufficient to form a second electrically conductive structure between and in contact with a second of the substrates and the semiconductor, the electrically conductive structure being substantially aligned with the second electric field, the semiconductor thus being transformed into the rectifying device.

3. The process of claim 1 or 2, wherein the source of the electrically conductive material is selected from the group consisting of a metal ion, a monomer which is electropolymerizable into a conductive polymer and an organic salt which is electrocrystallizable into a conductive crystal.

4. The process of claim 3, wherein the source of electrically conductive material is an ion selected from the group consisting of Cu, Ag, Au, Pd, Pt, Co, Ni, Zn, In, Ga, Fe, Pb, Al, W, Ir, Cr, Cd, Re, Os, Mn and Sn.

5. The process of claim 4, wherein the source of electrically conductive material is an ion selected from the group consisting of Cu and Ag.

6. The process of claim 1 or 2, wherein each substrate is independently selected from the group consisting of a metal, a metal oxide, a conductive polymer, a conductive organic salt crystal and a conductive form of carbon.

7. The process of claim 6, wherein each substrate is independently selected from the group consisting of Cu, Ag, Au and Pt.

8. The process according to claim 1 or 2, wherein the semiconductor is an n-type or a p-type and is selected from the group consisting of Si, InP, GaAs, CdS and CdSe.

9. The process of claim 1 or 2, wherein the environment is selected from the group consisting of a liquid and a gel, the environment having a dielectric constant lower than the dielectric constant for the substrate, the environment further being able to solvate the electroconductive material in a form in which the electroconductive material can electrodeposit onto the semiconductor upon application of an electric field.

10. The process of claim 9, wherein the environment is aqueous.

11. The process of claim 10, wherein the aqueous environment comprises water, an acid to remove oxides and a surfactant to prevent adhesion of gas bubbles.

12. The process of claim 9, wherein the environment comprises an organic solution.

13. The process of claim 12, wherein the organic solution is selected from the group consisting of acetonitrile and a mixture of toluene and acetonitrile in which the toluene is present in an amount of up to about 80 volume percent.

14. The process of claims 1 or 2, wherein each electrode comprises a material that will not electrodissolve in the environment.

15. The process of claim 14, wherein each electrode is independently selected from the group consisting of platinum, gold and graphite.

16. The process of claim 1 or 2, further comprising electrolessly plating an electrically conductive material onto the electrically conductive structures until a desired thickness of the electrically conductive material is obtained.

17. The process of claim 16, wherein the electrolessly plated electrically conductive structures are in contact with the substrates and the semiconductor.

18. The process of claim 1 or 2, further comprising removing from the e-environment the substrates, the semiconductor and the conductive structures between the substrates and the semiconductor, and electrolessly plating an electrically conductive material onto the electrically conductive structure until a desired thickness of the electrically conductive material is obtained.

19. The process of claim 1 or 2, wherein the environment is a liquid environment, the process further comprising removing from the environment the substrates, the semiconductor and the conductive structures between the substrates and the semiconductor, drying the electrically conductive structures between the substrates and the semiconductor, and electrolessly plating an electrically conductive material onto the electrically conductive structures until a desired thickness of the electrically conductive material is obtained.

20. The process of claim 19 wherein the electrolessly plated electrically conductive structures are in contact with the substrates and the semiconductor.

* * * * *